US009854359B1

(12) United States Patent
Chang

(10) Patent No.: US 9,854,359 B1
(45) Date of Patent: Dec. 26, 2017

(54) POP-FREE HEADSET DETECTION CIRCUIT

(71) Applicant: ANPEC ELECTRONICS CORPORATION, Hsinchu (TW)

(72) Inventor: Ming-Hung Chang, Hsinchu County (TW)

(73) Assignee: ANPEC ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 15/492,514

(22) Filed: Apr. 20, 2017

(30) Foreign Application Priority Data

Jan. 13, 2017 (TW) ..... 106101193 A

(51) Int. Cl.
*H04R 3/02* (2006.01)
*H04R 29/00* (2006.01)

(52) U.S. Cl.
CPC ..... *H04R 3/02* (2013.01); *H04R 29/004* (2013.01)

(58) Field of Classification Search
CPC ..... H04R 3/02; H04R 29/004
USPC ..... 381/74, 94.5
See application file for complete search history.

(56) References Cited

U.S. PATENT DOCUMENTS 7,623,667 B2 * 11/2009 Sander ..... H04M 1/05 381/384
8,831,241 B2 * 9/2014 Ma ..... H04R 3/007 381/74
9,014,388 B2 * 4/2015 Prentice ..... H04R 1/06 381/123
2005/0201568 A1 * 9/2005 Goyal ..... H04M 1/6058 381/74
2009/0136058 A1 * 5/2009 Choi ..... H04R 5/04 381/74
2011/0150234 A1 * 6/2011 Johnson ..... H01R 13/703 381/74
2013/0020882 A1 * 1/2013 Prentice ..... H04R 29/004 307/116
2013/0142350 A1 * 6/2013 Larsen ..... H04R 1/1041 381/74
2013/0156216 A1 * 6/2013 Shah ..... H04R 5/04 381/74
2014/0003616 A1 * 1/2014 Johnson ..... H04R 29/001 381/74
2014/0050330 A1 * 2/2014 Allen ..... H04R 3/00 381/74

(Continued)

*Primary Examiner* — David Ton
(74) *Attorney, Agent, or Firm* — Li&Cai Intellectual Property (USA) Office

(57) ABSTRACT

A pop-free headset detection circuit includes a socket unit, a first operational amplifier, a second operational amplifier and a detection and control circuit. An inverting input end of the first operational amplifier is connected to a left-channel audio source. A non-inverting input end of the first operational amplifier receives a first reference voltage. An inverting input end of the second operational amplifier is connected to a right-channel audio source. A non-inverting input end of the second operational amplifier receives a second reference voltage. When there is a headset plug of a headset plugged into the socket unit, the detection and control circuit controls the first operational amplifier and the second operational amplifier to be in a Hi-Z state, disconnects the first operational amplifier and the second operational amplifier and their feedback resistors, and then determines the type of the headset.

13 Claims, 7 Drawing Sheets

(56) References Cited

U.S. PATENT DOCUMENTS

| | | | | |
|---|---|---|---|---|
| 2015/0110331 | A1* | 4/2015 | Kwon | H04R 3/02 381/384 |
| 2015/0117663 | A1* | 4/2015 | Hsu | H04R 1/1041 381/74 |
| 2016/0056786 | A1* | 2/2016 | Howlett | H04R 3/00 381/94.5 |

* cited by examiner

POP-FREE HEADSET DETECTION CIRCUIT

BACKGROUND OF THE INVENTION

1. Field of the Invention

The present disclosure relates to a headset detection circuit; in particular, to a headset detection circuit that can prevent from generating noises when a signal is transmitted to detect a headset type.

2. Description of Related Art

Generally speaking, different types of headsets can be distinguished by their plugs. A headset plug may have three or four connectors, which depends on whether the headset is equipped with a microphone. Referring to FIG. 1A, a schematic diagram of a headset plug of a three-connector type headset is shown. The first connector, the second connector and the third connector of the headset plug of the three-connector type headset are respectively a TIP connector, a RING connector and a SLEEVE connector. The TIP connector is connected to a left-channel audio source L, the RING connector is connected to a right-channel audio source R and the SLEEVE connector is connected to a grounding end G. Referring to FIG. 1B and FIG. 1C, headset plugs of two four-connector type headsets are shown. The first connector, the second connector, the third connector and the fourth connector of the headset plug of the four-ring type headsets are respectively a TIP connector, a RING1 connector, a RING2 connector and a SLEEVE connector. The TIP connector is connected to a left-channel audio source L, and the RING1 connector is connected to a right-channel audio source R. However, the RING2 connector and the SLEEVE connector of the headset plugs of the two four-connector type headsets receive different signals. One type of the four-connector type headsets is manufactured under the Open Mobile Terminal Platform standard, and for this type of headset, the RING2 connector of the headset plug is connected to a microphone signal source M and the SLEEVE connector of the headset plug is connected to the grounding end G. Another type of the four-connector type headsets is manufactured under the Cellular Telecommunications Industry Association standard, and for this type of headset, the RING2 connector of the headset plug is connected to the grounding end G and the SLEEVE connector of the headset plug is connected to a microphone signal source M.

Different types of headsets are adapted to different electronic devices. Thus, when a headset plug is plugged into a headset socket of an electronic device, the electronic device first detects the type of the headset to determine if the plugged headset is the three-connector type headset, the OMTP headset or the CTIA headset. However, when a signal for detecting the headset is transmitted from the headset socket to the headset plug, noises are generated due to a voltage difference between the TIP connector and the RING connector, or that the grounding end G or a voltage difference between the TIP connector/RING1 connector and the grounding end G is large.

SUMMARY OF THE INVENTION

The present disclosure provides a pop-free headset detection circuit, used for detecting and determining the type of a headset. The pop-free headset detection circuit includes a socket unit, a first operational amplifier, a second operational amplifier and a detection and control circuit. The socket unit has a first pin, a second pin, a third pin, a fourth pin, a power supply pin and a driving pin. An output end of the first operational amplifier is connected to the first pin. An inverting input end of the first operational amplifier is connected to a left-channel audio source. A non-inverting input end of the first operational amplifier receives a first reference voltage. An output end of the second operational amplifier is connected to the second pin. An inverting input end of the second operational amplifier is connected to a right-channel audio source. A non-inverting input end of the second operational amplifier receives a second reference voltage. The detection and control circuit is connected to the third pin, the fourth pin and the driving pin. Additionally, the detection and control circuit is further connected to an enable end of the first operational amplifier and an enable end of the second operational amplifier. When there is a headset plug of a headset plugged into the socket unit, the voltage level of the driving signal inputted to the detection and control circuit changes. As a response, the detection and control circuit controls the first operational amplifier and the second operational amplifier to be in a Hi-Z state, and determines the type of the headset according to the voltage at the fourth pin.

In one embodiment of the pop-free headset detection circuit provided by the present disclosure, the pop-free headset detection circuit further includes a first switch and a second switch. One end of the first switch is connected to the inverting input end of the first operational amplifier, and the other end of the first switch is connected to the output end of the first operational amplifier through a feedback resistor. One end of the second switch is connected to the inverting input end of the second operational amplifier, and the other end of the second switch is connected to the output end of the second operational amplifier through another feedback resistor. Additionally, the detection and control circuit is further connected to the first switch and the second switch. When a headset plug of a headset is plugged into the socket unit, the voltage level of the driving signal inputted to the detection and control circuit changes. As a response, the detection and control circuit turns off the first switch and the second switch, and determines the type of the headset according to the voltage at the fourth pin. It should be noted that, the first pin of the socket unit is a TIP pin, the second pin of the socket unit is a RING1 pin, the third pin of the socket unit is a RING2 pin and the fourth pin of the socket unit is a SLEEVE pin.

In one embodiment of the pop-free headset detection circuit provided by the present disclosure, the detection and control circuit includes a third operational amplifier. A non-inverting input end of the third operational amplifier receives a ramp voltage. An inverting input end and an output end of the third operational amplifier are connected together. Additionally, the inverting input end and the output end of the third operational amplifier are further connected to the fourth pin of the socket unit. The third pin of the socket unit is connected to a grounding end. The detection and control circuit determines the type of the headset according to a voltage difference between the voltage at the fourth pin and the ramp voltage.

To sum up, when the pop-free headset detection circuit provided by the present disclosure is driven to detect the type of the headset, the first operational amplifier and the second operational amplifier are controlled to be in a Hi-Z state. Moreover, the first switch and the second switch are turned off, such that the first operational amplifier and its feedback resistor are disconnected, and the second operational amplifier and its feedback resistor are also disconnected. Under this circumstance, the first operational amplifier and the second operational amplifier are both in a Hi-Z state. Additionally, there is no voltage difference between the TIP pin of the socket unit and the grounding end, and between the RING1 pin of the socket unit and the grounding end. The TIP pin and the RING1 pin of the socket unit correspond to the TIP connector and the RING1 connector of the headset plug, and those skilled in the art should be familiar that the TIP connector of the headset plug is connected to a left-channel audio source, and the RING1 connector of the headset plug is connected to a right-channel audio source.

For further understanding of the present disclosure, reference is made to the following detailed description illustrating the embodiments of the present disclosure. The description is only for illustrating the present disclosure, not for limiting the scope of the claim.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

[One Embodiment of the Pop-Free Headset Detection Circuit]

Figure 1A:
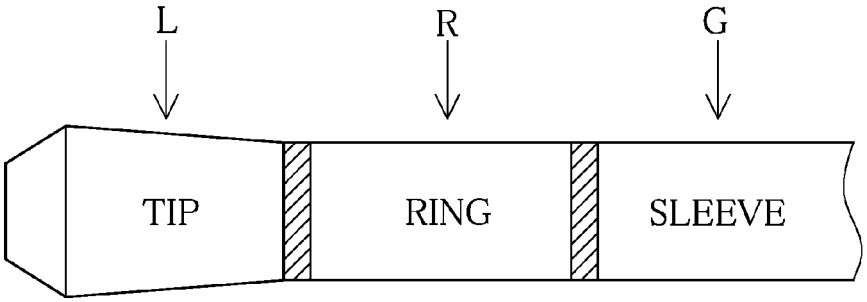
FIG. 1A shows a schematic diagram of a three-connector type headset.
Figure 1B:
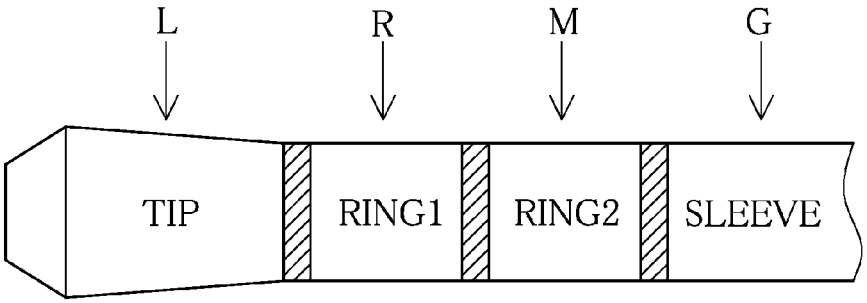
FIG. 1B shows a schematic diagram of an OMTP headset.
Figure 1C:
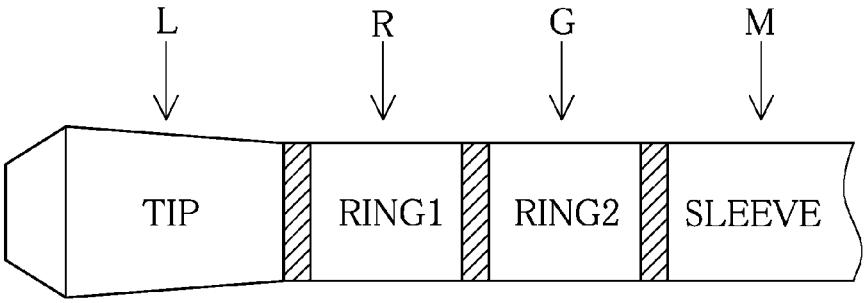
FIG. 1C shows a schematic diagram of a CTIA headset.
Figure 2:
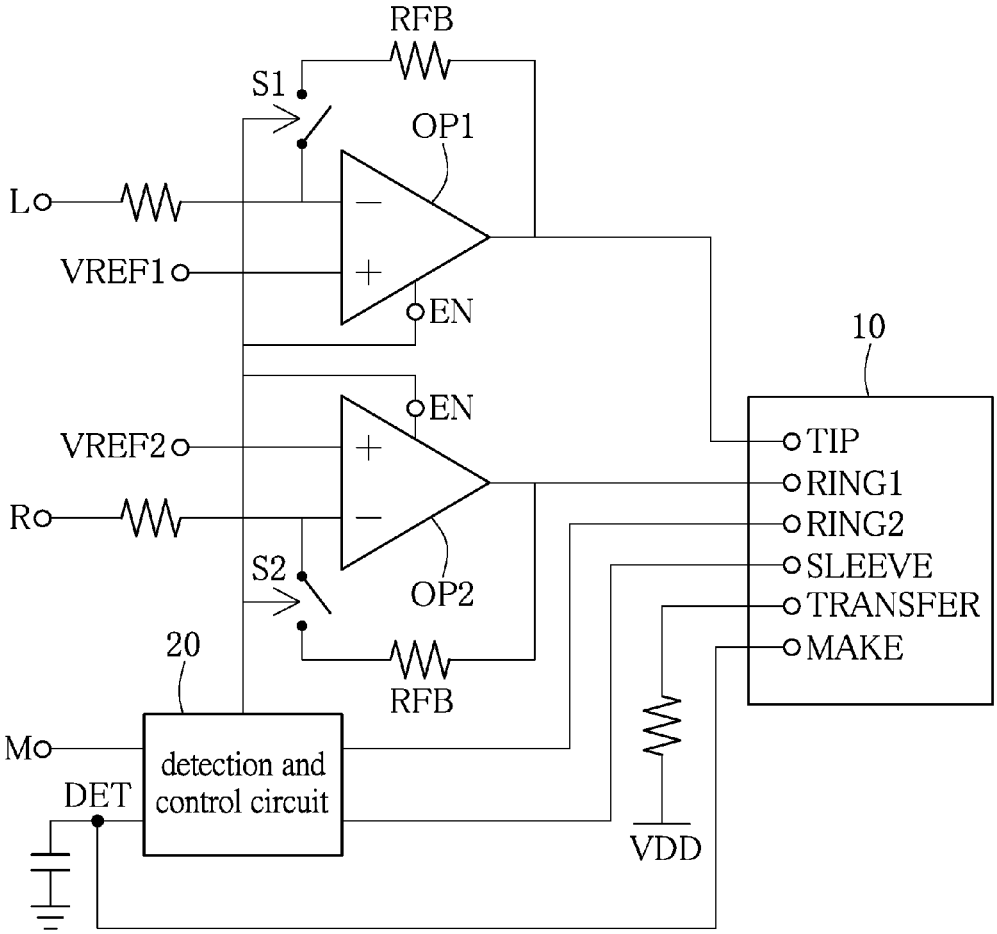
FIG. 2 shows a circuit diagram of a pop-free headset detection circuit of one embodiment of the present disclosure.

Referring to FIG. 2, a circuit diagram of a pop-free headset detection circuit of one embodiment of the present disclosure is shown. The pop-free headset detection circuit provided by this embodiment mainly includes a socket unit 10, a first operational amplifier OP1, a second operational amplifier OP2 and a detection and control circuit 20. The socket unit 10 has a first pin, a second pin, a third pin, a fourth pin, a power supply pin and a driving pin. It should be noted that, the first pin, the second pin, the third pin and the fourth pin of the socket unit 10 are the TIP pin, the RING1 pin, the RING2 pin and the SLEEVE pin that those skilled in the art should be familiar with. Also, the power supply pin and the driving pin of the socket unit 10 are the TRANSFER pin and the MAKE pin that those skilled in the art should be familiar with.

As shown in FIG. 2, the output end of the first operational amplifier OP1 is connected to the TIP pin, the inverting input end of the first operational amplifier OP1 is connected to a left-channel audio source, and a non-inverting input end of the first operational amplifier OP1 receives a first reference voltage VREF1. In addition, the output end of the second operational amplifier OP2 is connected to the RING1 pin, the inverting input end of the second operational amplifier OP2 is connected to a right-channel audio source, and a non-inverting input end of the second operational amplifier OP2 receives a second reference voltage VREF2. In addition, the detection and control circuit 20 is connected to RING2 pin, SLEEVE pin, and MAKE pin.

When there is no headset plug plugged into the socket unit 10, an open circuit is formed between the TRANSFER pin and the MAKE pin. Thus, the detection and control circuit 20 does not work. However, when there is a headset plug plugged into the socket unit 10, a short circuit is formed between the TRANSFER pin and the MAKE pin, such that a driving signal DET at high level can be transmitted from the TRANSFER pin to drive the detection and control circuit 20. As a result, the detection and control circuit 20 is driven to detect the type of the headset plug of a headset.

The pop-free headset detection circuit further includes a first switch S1 and a second switch S2. One end of the first switch S1 is connected to the inverting input end of the first operational amplifier OP1, and the other end of the first switch S1 is connected to the output end of the first operational amplifier OP1 through a feedback resistor RB. One end of the second switch S2 is connected to the inverting input end of the second operational amplifier OP2, and the other end of the second switch S2 is connected to the output end of the second operational amplifier OP2 through another feedback resistor RB. Additionally, the detection and control circuit 20 is further connected to an enable end EN of the first operational amplifier OP1, an enable end EN of the second operational amplifier OP2, the first switch S1 and the second switch S2.

When there is a headset plug of a headset plugged into the socket unit 10, and when the detection and control circuit 20 is driven, the detection and control circuit 20 controls the first operational amplifier OP1 and the second operational amplifier OP2 to be at a Hi-Z state. Simultaneously, the detection and control circuit 20 turns off the first switch S1 and the second switch S2. As shown in FIG. 2, when the detection and control circuit 20 turns off the first switch S1 and the second switch S2, the first operational amplifier OP1 and its feedback resistor RB are disconnected, and the second operational amplifier OP2 and its feedback resistor RB are also disconnected. After that, the detection and control circuit 20 determines the type of the headset according to the voltage at the SLEEVE pin of the socket unit 10.

In the following description, how the detection and control circuit 20 determines the type of the headset according to the voltage at the SLEEVE pin of the socket unit 10, and why the noises can be prevented when a signal is transmitted for detecting the type of a headset by using the pop-free headset detection circuit provided by this embodiment are illustrated.

Figure 3:
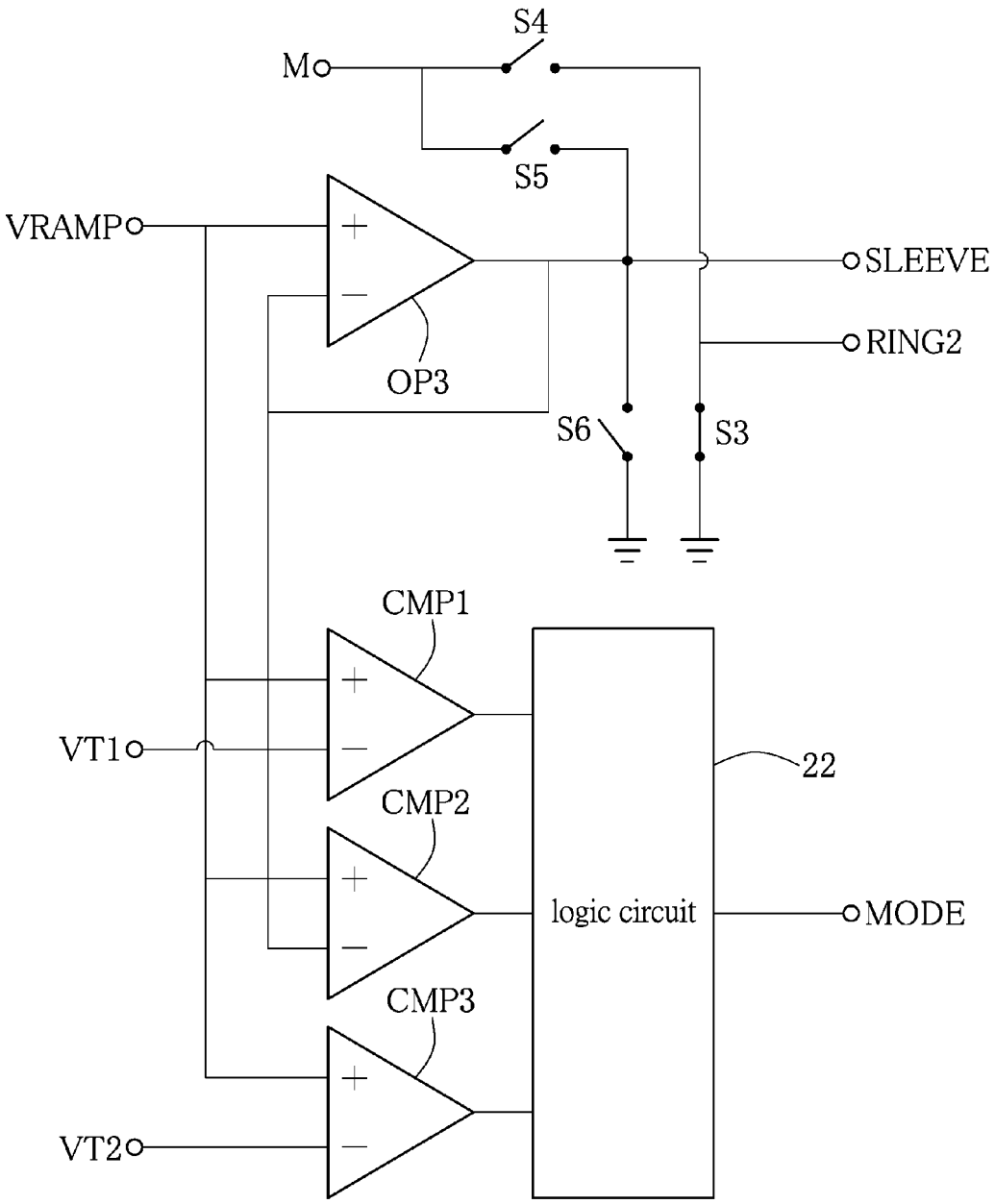
FIG. 3 shows a circuit diagram of a detection and control circuit in a pop-free headset detection circuit of one embodiment of the present disclosure.

Referring to FIG. 3, a circuit diagram of a detection and control circuit in a pop-free headset detection circuit of one embodiment of the present disclosure is shown. As shown in FIG. 3, the detection and control circuit 20 mainly includes a third operational amplifier OP3, a first comparator CMP1, a second comparator CMP2, a third comparator CMP3 and a logic circuit 22. A non-inverting input end of the third operational amplifier OP3 receives a ramp voltage VRAMP, and an inverting input end and an output end of the third operational amplifier OP3 are connected. In addition, the inverting input end and the output end of the third operational amplifier OP3 are further connected to the SLEEVE pin of the socket 10. It is worth mentioning that, the RING2 pin of the socket unit 10 is connected to a grounding end.

As shown in FIG. 3, the RING2 pin of the socket unit 10 is connected to the grounding end through a third switch S3, and is connected to a microphone signal source M through a fourth switch S4. The SLEEVE pin of the socket unit 10 is connected to the microphone signal source M through a fifth switch S5, and is connected to the grounding end through a sixth switch S6. At this time, the detection and control circuit 20 has not yet determined the type of the headset (such as the TRS type headset, the OMTP headset and the CTIA headset). When the detection and control circuit 20 is driven, the detection and control circuit 20 turns on the third switch S3, and turns off the fourth switch S4, the fifth switch S5 and the sixth switch S6. As shown in FIG. 3, the fourth switch S4 is turned off so that an open circuit is formed between the RING2 pin of the socket unit 10 and the microphone signal source M, and the fifth switch S5 of the socket unit 10 is turned off so that another open circuit is formed between the SLEEVE pin of the socket unit 10 and the microphone signal source M. In this manner, the signal for detecting the type of the headset does not affect the microphone signal source M.

A non-inverting input end of the first comparator CMP1 receives a ramp voltage VRAMP, and an inverting input end of the first comparator CMP1 receives a first threshold voltage VT1, to compare the ramp voltage VRAMP and the first threshold voltage VT1 and then generate a first comparison signal. A non-inverting input end of the second comparator CMP2 receives the ramp voltage VRAMP, and an inverting input end of the second comparator CMP2 is connected to a node between the inverting input end and the output end of the third operational amplifier OP3, to compare the ramp voltage VRAMP and the voltage at the SLEEVE pin of the socket unit 10 and then generate a second comparison signal. The non-inverting input end of the third comparator CMP3 receives the ramp voltage VRAMP, and the inverting input end of the third comparator CMP3 receives a second threshold voltage VT2, to compare the ramp voltage VRAMP and the second threshold voltage VT2 and then generate a third comparison signal.

It should be noted that, in this embodiment, the first threshold voltage VT1 is smaller than one turn-on voltage of a diode, and the second threshold voltage VT2 is larger than one turn-on voltage of a diode.

Figure 4A:
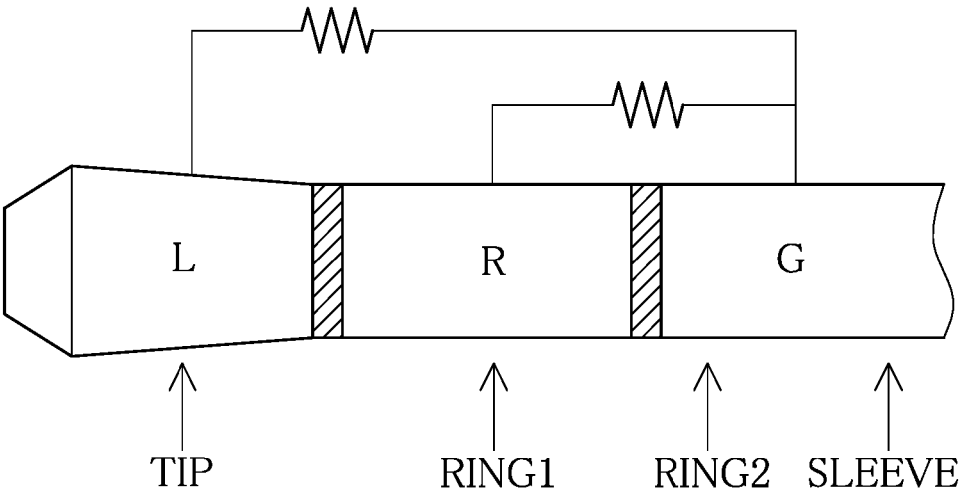
FIGS. 4A~4C show schematic diagrams illustrating equivalent circuits of a TRS type headset, an OMTP headset and a CTIA headset.
Figure 4B:
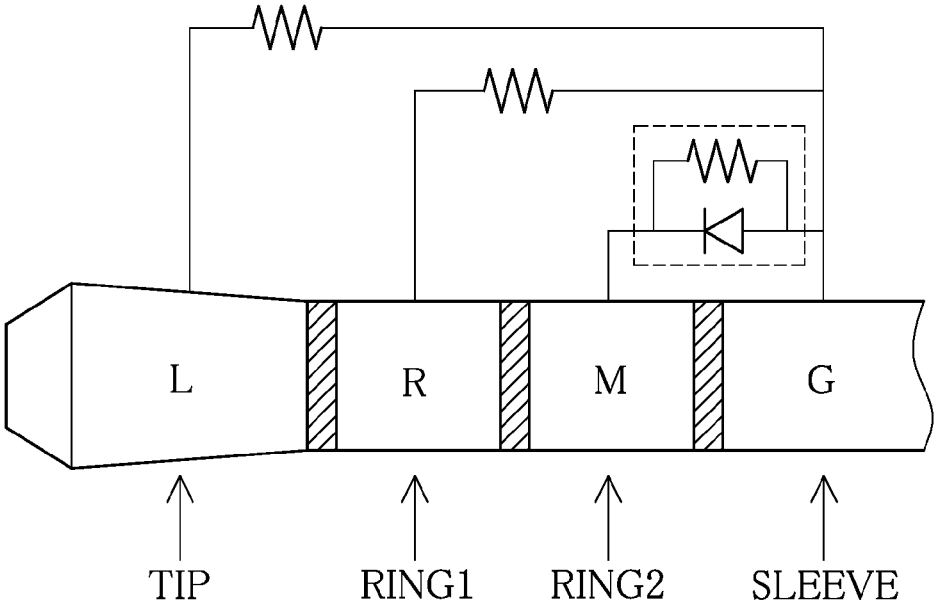
Figure 4C:
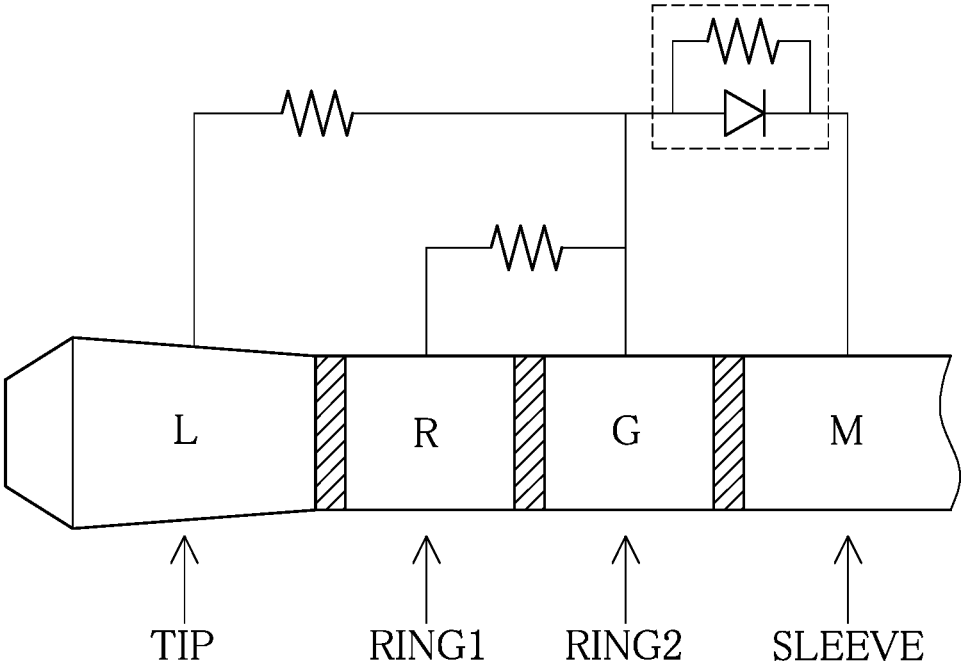
Figure 5:
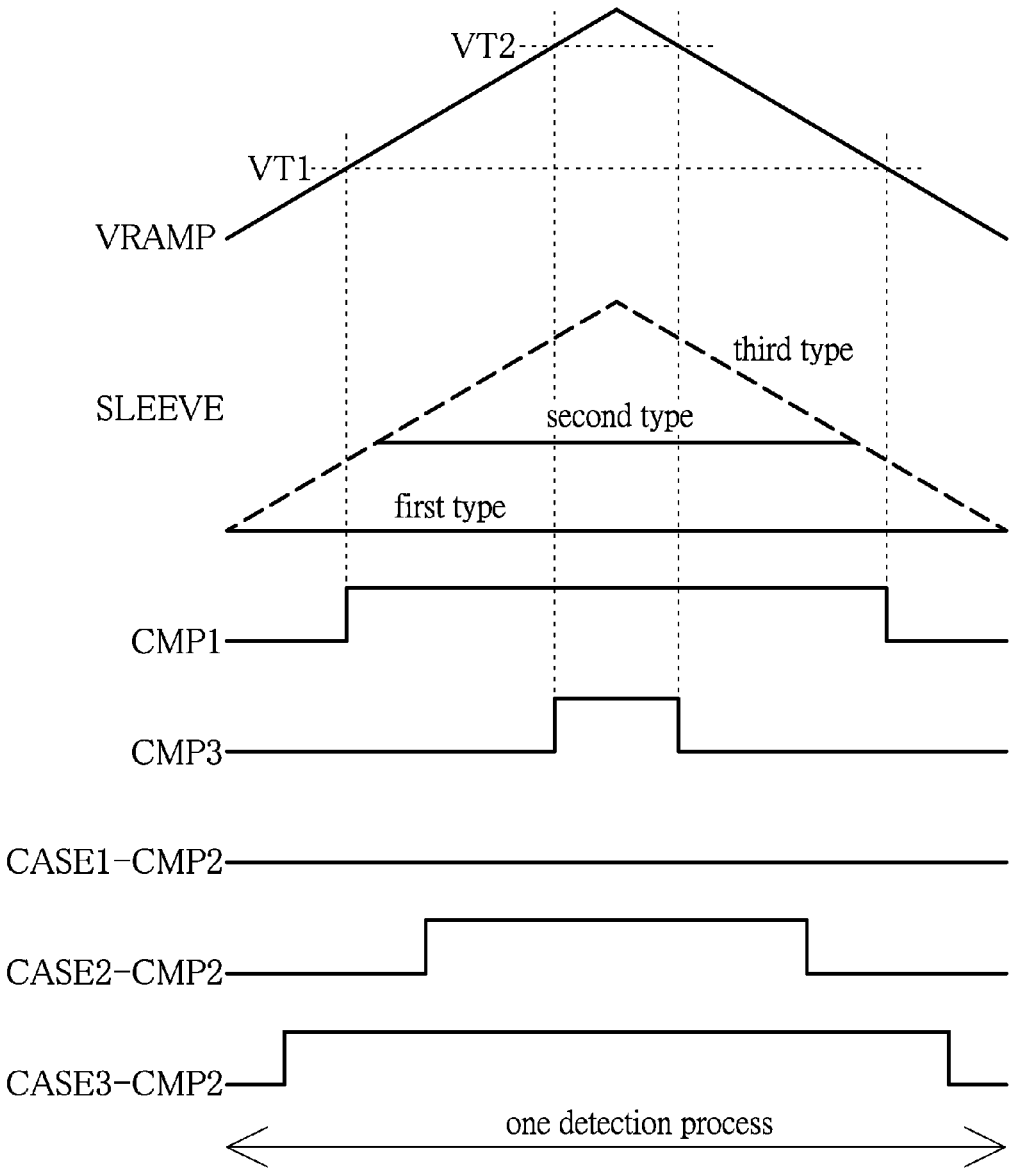
FIG. 5 shows a waveform diagram illustrating signals detected at the SLEEVE pin of the socket unit and at each output end of each comparator in the detection and control circuit, and illustrating a ramp voltage provided to the third operational amplifier in the detection and control circuit.

Referring to FIGS. 4A-4C, three schematic diagrams illustrating equivalent circuits of a TRS type headset, an OMTP headset and a CTIA headset are shown. Referring to FIG. 5, a waveform diagram is shown for illustrating signals detected at the SLEEVE pin of the socket unit and at each output end of each comparator in the detection and control circuit, and for illustrating a ramp voltage provided to the third operational amplifier in the detection and control circuit.

Those skilled in the art should be familiar that the more commonly used headsets are the TRS-type headset, the OMTP headset and the CTIA headset.

Regardless of whether the detected headset is the TRS-type headset, the OMTP headset or the CTIA headset, during each detection process, the first comparator CMP1 in FIG. 3 compares the ramp voltage VRAMP and the first threshold voltage VT1 and then generates a first comparison signal, so that the first comparison signal converts from low level to high level once the ramp voltage VRAMP is equal to the first threshold voltage VT1, as shown in FIG. 5. In addition, the third comparator CMP3 compares the ramp voltage VRAMP and the second threshold voltage VT2 and then generates a third comparison signal, so that the third comparison signal converts from low level to high level once the ramp voltage VRAMP is equal to the second threshold voltage VT2, as shown in FIG. 5. In other words, the timings when the first comparison signal and the third comparison signal convert from low level to high level are barely related to the type of the headset.

However, the timing when the second comparison signal converts from low level to high level is related to the type of the headset. During each detection process, the second comparator CMP2 compares the ramp voltage VRAMP and the voltage at the SLEEVE pin of the socket unit 10. The headset plugs of different types of headsets have different equivalent circuits. Thus, as shown in FIG. 5, for different types of headsets, the timing when the second comparison signal converts from low level to high level is determined according to the equivalent circuits of their headset plugs and the voltage difference between the ramp voltage VRAMP and the voltage at the SLEEVE pin of the socket unit 10.

The equivalent circuit of a headset plug of a TRS-type headset having the TIP pin, the RING pin and the SLEEVE pin, is shown in FIG. 4A. In addition to the fact that the RING2 pin of the socket unit 10 is connected to the grounding end, the SLEEVE pin and RING2 pin of the socket unit 10 are connected to a common node, as shown in FIG. 4A. Thus, even while the ramp voltage VRAMP increases, the voltage at the SLEEVE pin of the socket unit 10 maintains at zero. In this case, a voltage difference between the ramp voltage VRAMP and the voltage at the SLEEVE pin soon increases to the voltage that converts an output signal of the second comparator CMP2 from low level to high level. As a result, the second comparison signal converts from low level to high level even when the voltage at the SLEEVE pin of the socket unit 10 is less than the first threshold voltage VT1, as shown by the waveform diagram of CASE3-CMP2 in FIG. 5.

The equivalent circuit of a headset plug of an OMTP headset having the TIP pin, the RING1 pin, the RING2 pin and the SLEEVE pin, is shown in FIG. 4B. As shown in FIG. 4B, the equivalent circuit between the RING2 pin and the SLEEVE pin can be considered a diode with a resistor which is from ~KΩ to ~MΩ connected in parallel, wherein the SLEEVE pin of the socket unit 10 is connected to the positive end of the diode. Thus, as shown in FIG. 5, when the ramp voltage VRAMP begins to increase, the voltage at the SLEEVE pin of the socket unit 10 also increases. However, when the voltage at the SLEEVE pin of the socket unit 10 increases to one turn-on voltage of a diode, as shown in FIG. 4B, the diode is tuned on and the voltage at the SLEEVE pin of the socket unit 10 maintains at the turn-on voltage of the diode. In this case, when a voltage difference between the ramp voltage VRAMP and the voltage at the SLEEVE pin increases to a value that is enough to make the second comparison signal convert from low level to high level (as shown by the waveform diagram of CASE2-CMP2 in FIG. 5), the voltage at the SLEEVE pin of the socket unit 10 is larger than the first threshold voltage VT1 but smaller than the second threshold voltage VT2.

The equivalent circuit of a headset plug of a CITA headset having the TIP pin, the RING1 pin, the RING2 pin and the SLEEVE pin, is shown in FIG. 4C. As shown in FIG. 4C, the equivalent circuit between the RING2 pin and the SLEEVE pin can be considered diode with a resistor which is from ~K Ω to ~MΩ connected in parallel, wherein the SLEEVE pin of the socket unit 10 is connected to the negative end of the diode. Thus, as shown in FIG. 5, when the ramp voltage VRAMP begins to increase, the voltage at the SLEEVE pin of the socket unit 10 also increases. However, even if the voltage at the SLEEVE pin of the socket unit 10 increases, it cannot turn on a reversed-biased diode. Thus, the voltage at the SLEEVE pin of the socket unit 10 continues to vary with the ramp voltage VRAMP. As a result, the second comparison signal maintains at low level (as shown by the waveform diagram of CASE1-CMP2 in FIG. 5).

According to the above, the logic circuit 22 can determine the type of the detected headset according to the second comparison signal with the first comparison signal and the third comparison signal as references, which are shown in FIG. 5.

With the first comparison signal and the third comparison signal as references, if the logic circuit 22 determines that the voltage of the SLEEVE pin is less than the first threshold voltage VT1 when the second comparison signal converts from low level to high level, the logic circuit 22 outputs a MODE signal as shown in FIG. 3. According to this MODE signal, the detection and control circuit 20 determines that the type of the detected headset is a first type. As shown in FIG. 4A, the first-type headset is the TRS-type headset. In the TRS-type headset, the TIP pin of the socket unit 10 should be connected to the left-channel audio source L, the RING1 pin of the socket unit 10 should be connected to the right-channel audio source R, and the RING2 pin and the SLEEVE pin of the socket unit 10 should be connected to the grounding end G. Thus, the detection and control circuit 20 turns on the sixth switch S6 and the third switch S3, such that the RING2 pin and the SLEEVE pin of the socket unit 10 are connected to the grounding end. However, it should be noted that, the fourth switch S4 and the fifth switch S5 are still turned off.

Likewise, with the first comparison signal and the third comparison signal as references, if the logic circuit 22 determines that the voltage of the SLEEVE pin is larger than the first threshold voltage VT1 but smaller than the second threshold voltage VT2 when the second comparison signal converts from low level to high level, the logic circuit 22 outputs a MODE signal as shown in FIG. 3. According to this MODE signal, the detection and control circuit 20 determines that the type of the detected headset is a second type. As shown in FIG. 4B, the second-type headset is the OMTP headset. In the OMTP headset, the TIP pin of the socket unit 10 should be connected to the left-channel audio source L, the RING1 pin of the socket unit 10 should be connected to the right-channel audio source R, the RING2 pin of the socket unit 10 should be connected to the microphone signal source M, and the SLEEVE pin of the socket unit 10 should be connected to the grounding end G. Thus, the detection and control circuit 20 turns off the third switch S3 and the fifth switch S5 and turns on the fourth switch S4 and the sixth switch S6, such that the SLEEVE pin of the socket unit 10 is connected to the grounding end and a short circuit is formed between the RING2 pin of the socket unit 10 and the microphone signal source M.

Moreover, with the first comparison signal and the third comparison signal as references, if the logic circuit 22 determines that the second comparison signal maintains at low level even if the voltage at the SLEEVE pin of the socket unit 10 continues to increase, the logic circuit 22 outputs a MODE signal as shown in FIG. 3. According to this MODE signal, the detection and control circuit 20 determines that the type of the detected headset is a third type. As shown in FIG. 4C, the third-type headset is the CTIA headset. In the CTIA headset, the TIP pin of the socket unit 10 should be connected to the left-channel audio source L, the RING1 pin of the socket unit 10 should be connected to the right-channel audio source R, the RING2 pin of the socket unit 10 should be connected to the grounding end G, and the SLEEVE pin of the socket unit 10 should be connected to the microphone signal source M. Thus, the detection and control circuit 20 turns off the fourth switch S4 and the sixth switch S6 and turns on the third switch S3 and the fifth switch S5, such that the RING2 pin of the socket unit 10 is connected to the grounding end G and a short circuit is formed between the SLEEVE pin of the socket unit 10 and the microphone signal source M. It is worth mentioning that, the third operational amplifier OP3 is shut down and is controlled to be in a Hi-Z state as soon as the detection process has been finished.

According to the above description, during the detection process, the pop-free headset detection circuit provided by the present disclosure has a ramp voltage VRAMP inputted to the third operational amplifier OP3 and determines the type of the headset according to the second comparison signal with the first comparison signal and the third comparison signal as references. It is worth mentioning that, during the detection process, the detection and control circuit 20 controls the first operational amplifier OP1 and the second operational amplifier OP2 to be in a Hi-Z state. Additionally, the detection and control circuit 20 turns off the first switch S1 and the second switch S2, such that the first operational amplifier OP1 and its feedback RB are disconnected and the second operational amplifier OP2 and its feedback RB are also disconnected. As a result, there is no voltage difference between the TIP pin and the grounding end, and there is no voltage difference between the RING1 pin of the socket unit 10 and the grounding end (the TIP pin and the RING1 pin of the socket unit 10 correspond to the TIP connector and the RING1 connector of the headset plug). Under this circumstance, there will be no noise generated when the pop-free headset detection circuit provided by the present disclosure transmits a signal for detecting the type of the headset.

To sum up, when the pop-free headset detection circuit provided by the present disclosure is driven to detect the type of the headset, the first operational amplifier and the second operational amplifier are controlled to be in a Hi-Z state. Moreover, the first switch and the second switch are turned off, such that the first operational amplifier and its feedback resistor are disconnected, and the second operational amplifier and its feedback resistor are also disconnected. Under this circumstance, the first operational amplifier and the second operational amplifier are both in a Hi-Z state. Additionally, there is no voltage difference between the TIP pin of the socket unit and the grounding end, and there is no voltage difference between the RING1 pin of the socket unit and the grounding end. The TIP pin and the RING1 pin of the socket unit correspond to the TIP connector and the RING1 connector of the headset plug, and those skilled in the art should be familiar that, the TIP connector of the headset plug is connected to the left-channel audio source and the RING1 connector of the headset plug is connected to the right-channel audio source.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A pop-free headset detection circuit, used for detecting and determining the type of a headset, comprising:

a socket unit, having a first pin, a second pin, a third pin, a fourth pin, a power supply pin and a driving pin;

a first operational amplifier, having an output end connected to the first pin, having an inverting input end connected to a left-channel audio source and having a non-inverting input end receive a first reference voltage;

a second operational amplifier, having an output end connected to the second pin, having an inverting input end connected to a right-channel audio source and having a non-inverting input end receive a second reference voltage; and a detection and control circuit, connected to the third pin, the fourth pin and the driving pin;

wherein the detection and control circuit is further connected to an enable end of the first operational amplifier and an enable end of the second operational amplifier, and when a headset plug of the headset is plugged into the socket unit, the detection and control circuit controls the first operational amplifier and the second operational amplifier to be in a Hi-Z state and determines the type of the headset according to the voltage at the fourth pin;

wherein the first pin is a TIP pin, the second pin is a RING1 pin, the third pin is a RING2 pin and the fourth pin is a SLEEVE pin.

2. The pop-free headset detection circuit according to claim 1, further comprising:

a first switch, having one end connected to the inverting input end of the first operational amplifier and having the other end connected to the output end of the first operational amplifier through a feedback resistor; and a second switch, having one end connected to the inverting input end of the second operational amplifier and having the other end connected to the output end of the second operational amplifier through another feedback resistor;

wherein the detection and control circuit is further connected to the first switch and the second switch, and when the headset plug of the headset is plugged into the socket unit, the detection and control circuit turns off the first switch and the second switch and determines the type of the headset according to the voltage at the fourth pin of the socket unit.

3. The pop-free headset detection circuit according to claim 2, wherein the detection and control circuit includes:

a third operational amplifier, having a non-inverting input end receive a ramp voltage, having an inverting input end and an output end connected together, wherein the inverting input end and the output end of the third operational amplifier are further connected to the fourth pin of the socket unit;

wherein the third pin of the socket unit is connected to a grounding end, and the detection and control circuit determines the type of the headset according to a voltage difference between the voltage at the fourth pin of the socket unit and the ramp voltage.

4. The pop-free headset detection circuit according to claim 2, wherein the third pin of the socket unit is connected to the grounding end through a third switch and is connected to a microphone signal source through a fourth switch, the fourth pin of the socket unit is connected to the microphone signal source through a fifth switch and is connected to the grounding end through a sixth switch;

wherein when the detection and control circuit is driven, the detection and control circuit turns on the third switch and turns off the fourth switch, the fifth switch and the sixth switch, such that an open circuit is formed between the third pin of the socket unit and the microphone signal source, and another open circuit is formed between the fourth pin of the socket unit and the microphone signal source.

5. The pop-free headset detection circuit according to claim 3, wherein the detection and control circuit further includes:

a first comparator, having a non-inverting input end receive the ramp voltage, having an inverting input end receive a first threshold voltage, wherein the first comparator compares the ramp voltage and the first threshold voltage and generates a first comparison signal;

a second comparator, having a non-inverting input end receive the ramp voltage, having an inverting input end connected to a node between the inverting input end and the output end of the third operational amplifier, wherein the second comparator compares the ramp voltage and the voltage at the fourth pin of the socket unit and generates a second comparison signal;

a third comparator, having a non-inverting input end receive the ramp voltage, having an inverting input end receive a second threshold voltage, wherein the third comparator compares the ramp voltage and the second threshold voltage and generates a third comparison signal; and a logic circuit, connected to the first comparator, the second comparator and the third comparator, wherein the logic circuit determines the type of the headset according to the first comparison signal, the second comparison signal and the third comparison signal.

6. The pop-free headset detection circuit according to claim 5, wherein the first threshold voltage is smaller than a turn-on voltage of a diode, and the second threshold voltage is larger than the turn-on voltage of the diode.

7. The pop-free headset detection circuit according to claim 5, wherein according to the first comparison signal, the second comparison signal and the third comparison signal, if the detection and control circuit determines that the second comparison signal converts from low level to high level when the voltage at the fourth pin of the socket unit is smaller than the first threshold voltage, the detection and control circuit determines that the type of the headset is a first type.

8. The pop-free headset detection circuit according to claim 7, wherein according to the first comparison signal, the second comparison signal and the third comparison signal, if the detection and control circuit determines that the second comparison signal converts from low level to high level when the voltage at the fourth pin of the socket unit is larger than the first threshold voltage but smaller than the second threshold voltage, the detection and control circuit determines that the type of the headset is a second type.

9. The pop-free headset detection circuit according to claim 8, wherein when the detection and control circuit determines that the type of the headset is the second type, the detection and control circuit turns off the third switch and the fifth switch and turns on the fourth switch and the sixth switch, such that the fourth pin of the socket is connected to the grounding end and a short circuit is formed between the third pin of the socket unit and the microphone signal source.

10. The pop-free headset detection circuit according to claim 7, wherein according to the first comparison signal, the second comparison signal and the third comparison signal, if the detection and control circuit determines that the second comparison signal stays at low level even when the voltage at the fourth pin of the socket unit continues to increase and is over the second threshold voltage, the detection and control circuit determines that the type of the headset is a third type.

11. The pop-free headset detection circuit according to claim 10, wherein when the detection and control circuit determines that the type of the headset is the third type, the detection and control circuit turns on the third switch and the fifth switch and turns off the fourth switch and the sixth switch, such that a short circuit is formed between the fourth pin of the socket unit and the microphone signal source, and the third pin of the socket unit is connected to the grounding end.

12. The pop-free headset detection circuit according to claim 7, wherein when the detection and control circuit determines that the type of the headset is the first type, the detection and control circuit turns on the third switch and the six switch and turns off the fourth switch and the fifth switch, such that the third pin and the fourth pin of the socket unit are connected to the grounding end.

13. The pop-free headset detection circuit according to claim 1, wherein an open circuit is formed between the power supply pin and the driving pin when no headset plug of the headset is plugged into the socket unit, and when the headset plug of the headset is plugged into the socket unit, a short circuit is formed between the power supply pin and the driving pin of the socket unit and a driving signal at high level is transmitted from the driving pin to drive the detection and control circuit.

* * * * *